US007638710B1

(12) United States Patent
Vance

(10) Patent No.: US 7,638,710 B1
(45) Date of Patent: Dec. 29, 2009

(54) OUTLET ATTACHMENT SYSTEM

(76) Inventor: Alan D. Vance, 32705 60th Ave., Cushing, MN (US) 56443

( * ) Notice: Subject to any disclaimer, the term of this patent is extended or adjusted under 35 U.S.C. 154(b) by 264 days.

(21) Appl. No.: 11/874,237

(22) Filed: Oct. 18, 2007

(51) Int. Cl.
*H01H 9/02* (2006.01)

(52) U.S. Cl. ..... 174/53; 174/57; 174/135; 174/66; 439/147; 439/650; 220/241

(58) Field of Classification Search ..... 174/66, 174/53, 57, 135, 59; 439/373, 147, 135, 439/650, 536; 220/241, 3.2, 3.3
See application file for complete search history.

(56) References Cited

U.S. PATENT DOCUMENTS 6,281,434 B1 * 8/2001 Gretz ..... 174/502
6,375,487 B1 * 4/2002 Tennessen ..... 439/373
6,699,060 B1 3/2004 Scott
7,309,834 B1 * 12/2007 Byrd ..... 174/53
7,347,724 B2 * 3/2008 Crupi ..... 439/535

* cited by examiner

*Primary Examiner*—Dhiru R Patel

(57) ABSTRACT

An outlet attachment system for efficiently securing an electrical plug to an outlet. The outlet attachment system generally includes an inner support structure including at least one channel and at least one stopper member, wherein the channel(s) extends through the inner support structure. The channel(s) includes a front portion and a rear portion, wherein the front portion extends from the rear portion. The stopper member(s) extends partially within the channel(s) between the front portion and the rear portion. The inner support structure is secured adjacent an outlet(s), wherein the rear portion of the channel(s) aligns with the outlet(s). An outer support structure may also be utilized to secure the present invention adjacent the outlet, wherein the inner support structure is secured within the outer support structure.

20 Claims, 6 Drawing Sheets

OUTLET ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an electrical outlet and more specifically it relates to an outlet attachment system for efficiently securing an electrical plug to an outlet.

2. Description of the Related Art

Any discussion of the related art throughout the specification should in no way be considered as an admission that such related art is widely known or forms part of common general knowledge in the field.

Electrical outlets have been in use for years. The hole arrangement of the outlet may be comprised of various configurations according to a specific country's electrical requirements or the type of plug that is required for a particular electrical connection. When a respective plug of an electrical cord is inserted within the holes of the outlet an electrical connection is made between the power supply connected to the outlet and the electrical cord.

The mechanical connection made between the plug and the outlet is generally not substantially strong, wherein if an outward force is applied to the cord (e.g. person pulling on it, person tripping over it, etc.) the plug will generally become disconnected from the outlet. This can be a nuisance in that the person must generally reinsert the plug within the outlet which may take up valuable time and cause the person to interrupt what they are currently doing.

The plug may also become partially disconnected from the outlet at times, which exposes a portion of the plug (i.e. metal portion) thus allowing the possibility that a person will touch the exposed portion and receive a shock. Because of the inherent problems with the related art, there is a need for a new and improved outlet attachment system for efficiently securing an electrical plug to an outlet.

BRIEF SUMMARY OF THE INVENTION

The general purpose of the present invention is to provide an outlet attachment system that has many of the advantages of the outlets mentioned heretofore. The invention generally relates to an outlet which includes an inner support structure including at least one channel and at least one stopper member, wherein the channel(s) extends through the inner support structure. The channel(s) includes a front portion and a rear portion, wherein the front portion extends from the rear portion. The stopper member(s) extends partially within the channel(s) between the front portion and the rear portion. The inner support structure is secured adjacent an outlet(s), wherein the rear portion of the channel(s) aligns with the outlet(s). An outer support structure may also be utilized to secure the present invention adjacent the outlet, wherein the inner support structure is secured within the outer support structure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an outlet attachment system for efficiently securing one or more electrical plugs within the outlet.

Another object is to provide an outlet attachment system that is easily attached to an electrical outlet.

An additional object is to provide an outlet attachment system that reduces the likelihood of an individual receiving a shock from an outlet by preventing the outlet from being partially disconnected.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
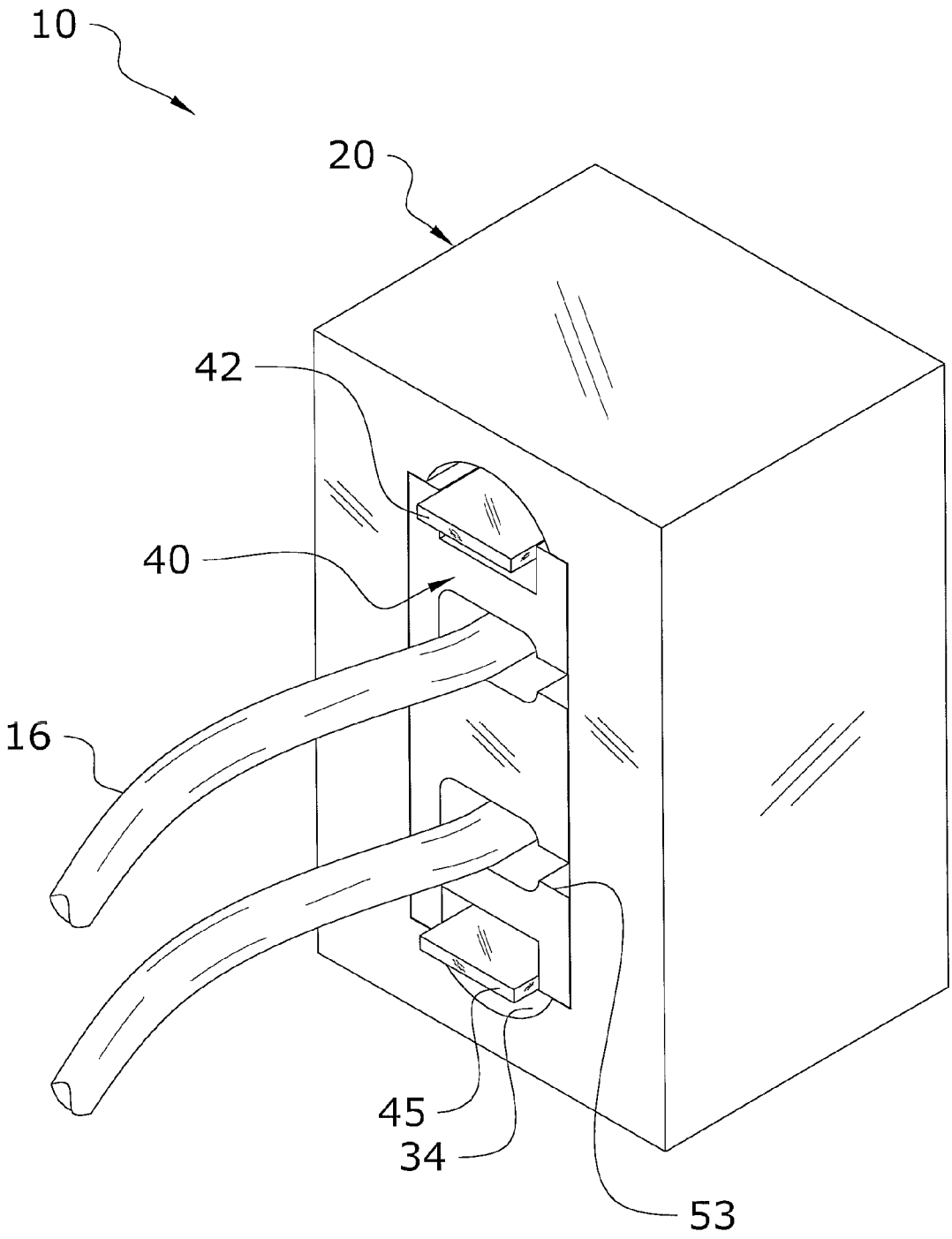
FIG. 1 is an upper perspective view of the present invention with an electrical cord extending through the inner support structure.

Turning now descriptively to the drawings, in which similar reference characters denote similar elements throughout the several views, FIGS. 1 through 6 illustrate an outlet attachment system 10, which comprises an inner support structure 40 including at least one channel 50 and at least one stopper member 55, wherein the channel(s) 50 extends through the inner support structure 40. The channel(s) 50 includes a front portion 52 and a rear portion 51, wherein the front portion 52 extends from the rear portion 51. The stopper member(s) 55 extends partially within the channel(s) 50 between the front portion 52 and the rear portion 51. The inner support structure 40 is secured adjacent an outlet(s) 12, wherein the rear portion 51 of the channel(s) 50 aligns with the outlet(s) 12. An outer support structure 20 may also be utilized to secure the present invention adjacent the outlet 12, wherein the inner support structure 40 is secured within the outer support structure 20.

B. Outlet

Figure 2:
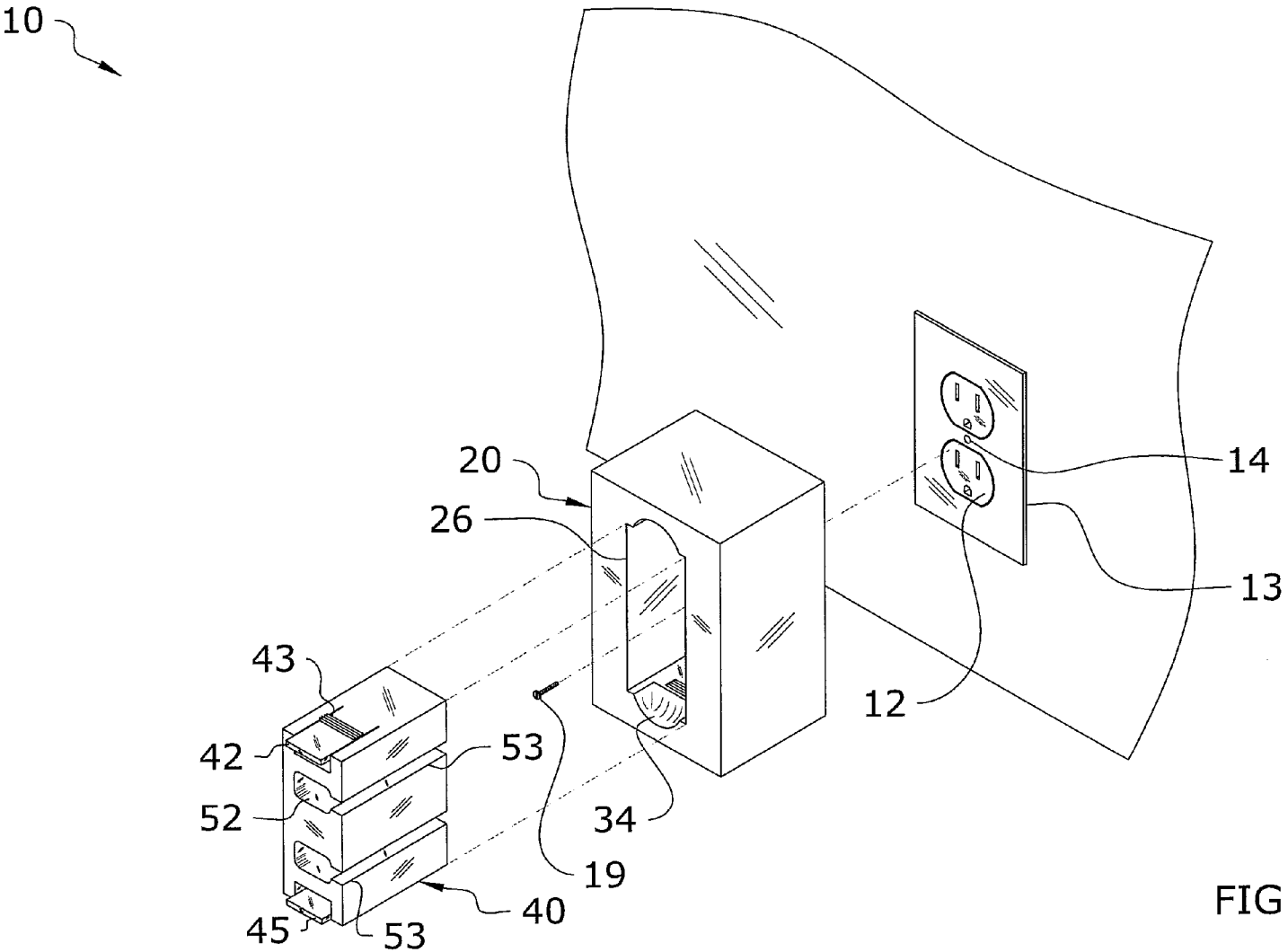
FIG. 2 is an exploded upper perspective view of the present invention, wherein the present invention is also exploded from an outlet.

The outlet 12 that the present invention removably attaches to is comprised of an electrical outlet configuration as illustrated in FIG. 2. The present invention may attach to outlets 12 including various configurations of prong receptacles (e.g. 2 prong receptacle, 3 prong receptacle, etc.).

The present invention may also attach to various types and configurations of wall plates 13 surrounding the outlet 12 and also wall plates 13 with various numbers of outlets 12 electrically wired and extending through. The preferred embodiment of the present invention is illustrated as attaching to a wall plate 13 including a 3-prong/2 outlet 12 configuration as illustrated in FIG. 2; however it is appreciated that the present invention may attach to various outlet 12 and wall plate 13 configurations rather than the preferred embodiment.

C. Outer Support Structure

The present invention preferably includes an outer support structure 20 to removably attach to the wall plate 13 of the outlet 12 as illustrated in FIGS. 2 through 5. The outer support structure 20 may be comprised of various shapes and configurations to attach to various configuration outlets 12 and/or wall plates 13. The outer support structure 20 is also preferably comprised of a substantially non-conductive material, such as but not limited to plastic, to reduce the likelihood of electrical shock when handling the outer support structure 20.

Figure 3:
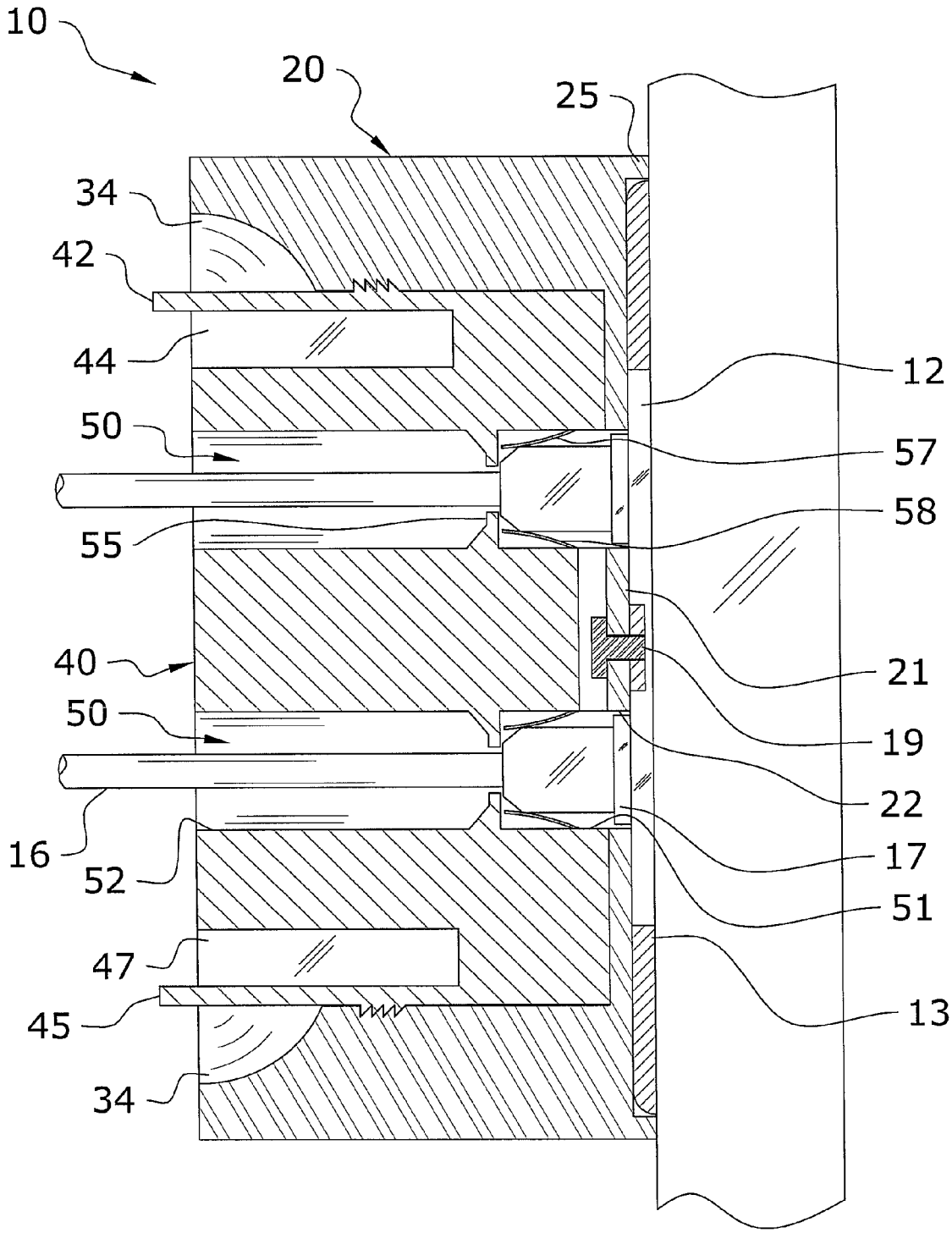
FIG. 3 is a longitudinal cross-sectional view of the present invention attached to an outlet and in use, wherein the inner support structure is secured within the outer support structure.
Figure 4:
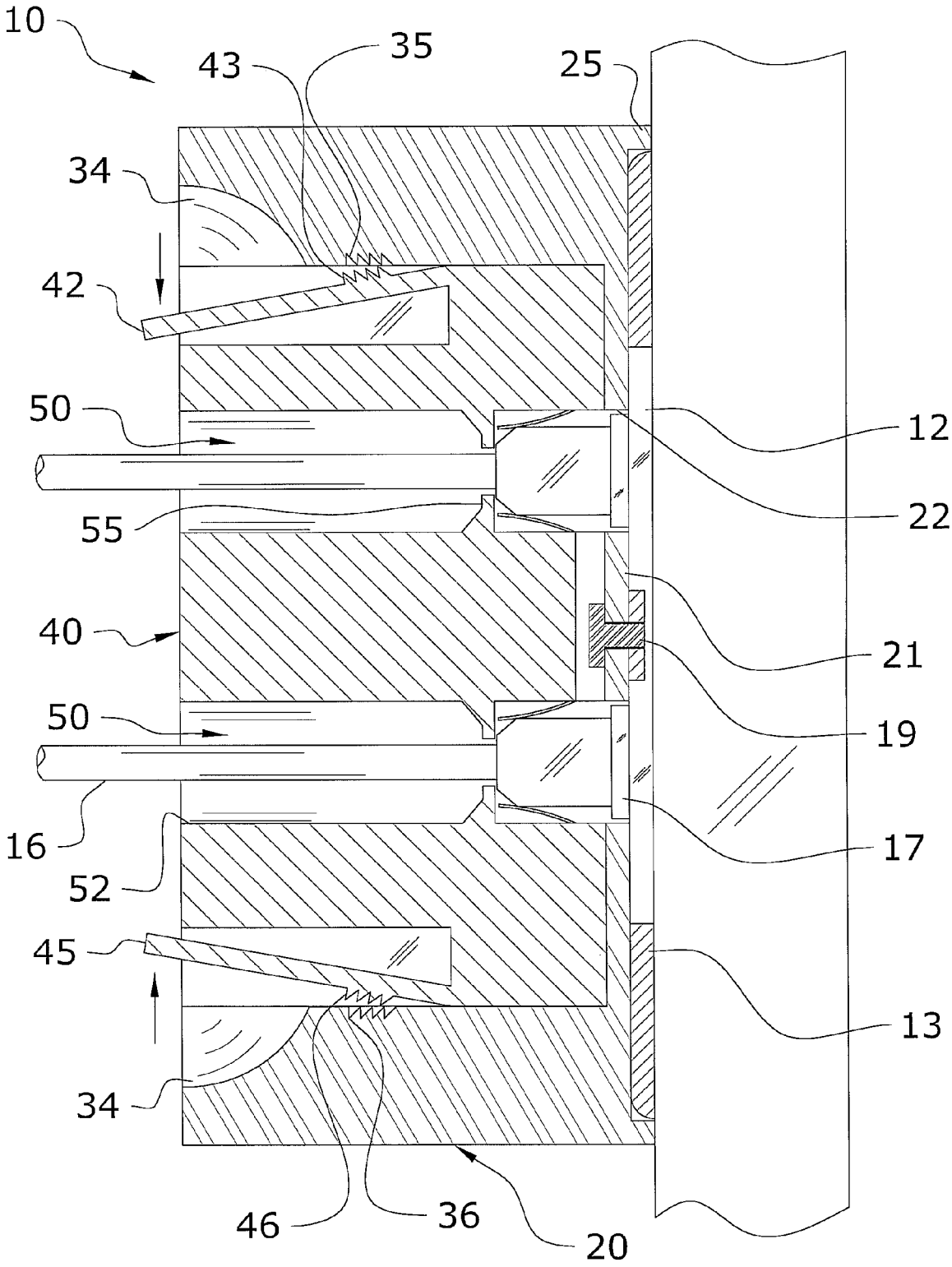
FIG. 4 is a longitudinal cross-sectional view of the present invention attached to an outlet and in use, wherein the tabs are being depressed thus releasing the inner support structure from the outer support structure.
Figure 5:
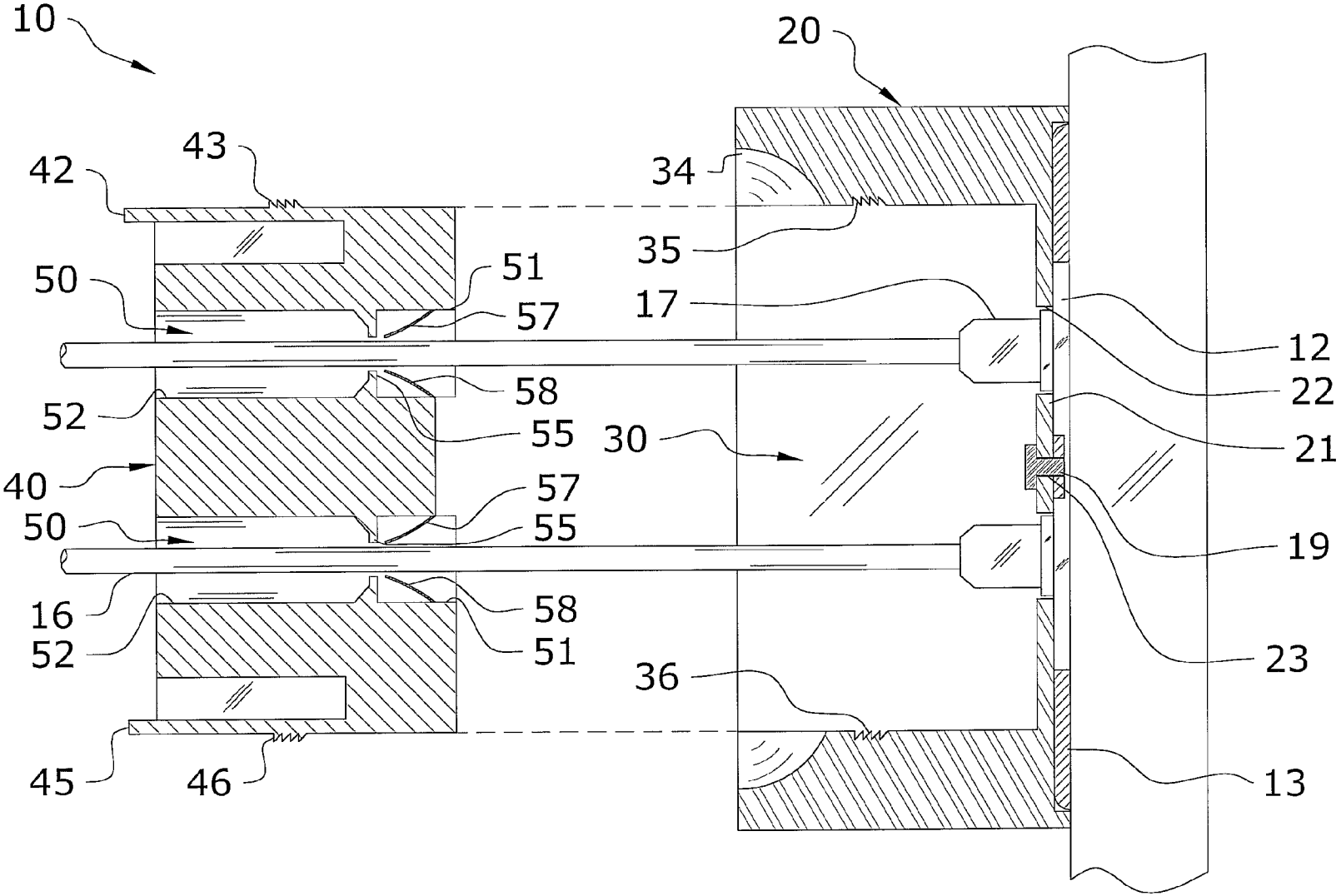
FIG. 5 is a longitudinal cross-sectional view of the present invention attached to an outlet and in use, wherein the inner support structure is removed from the outer support structure.
Figure 6:
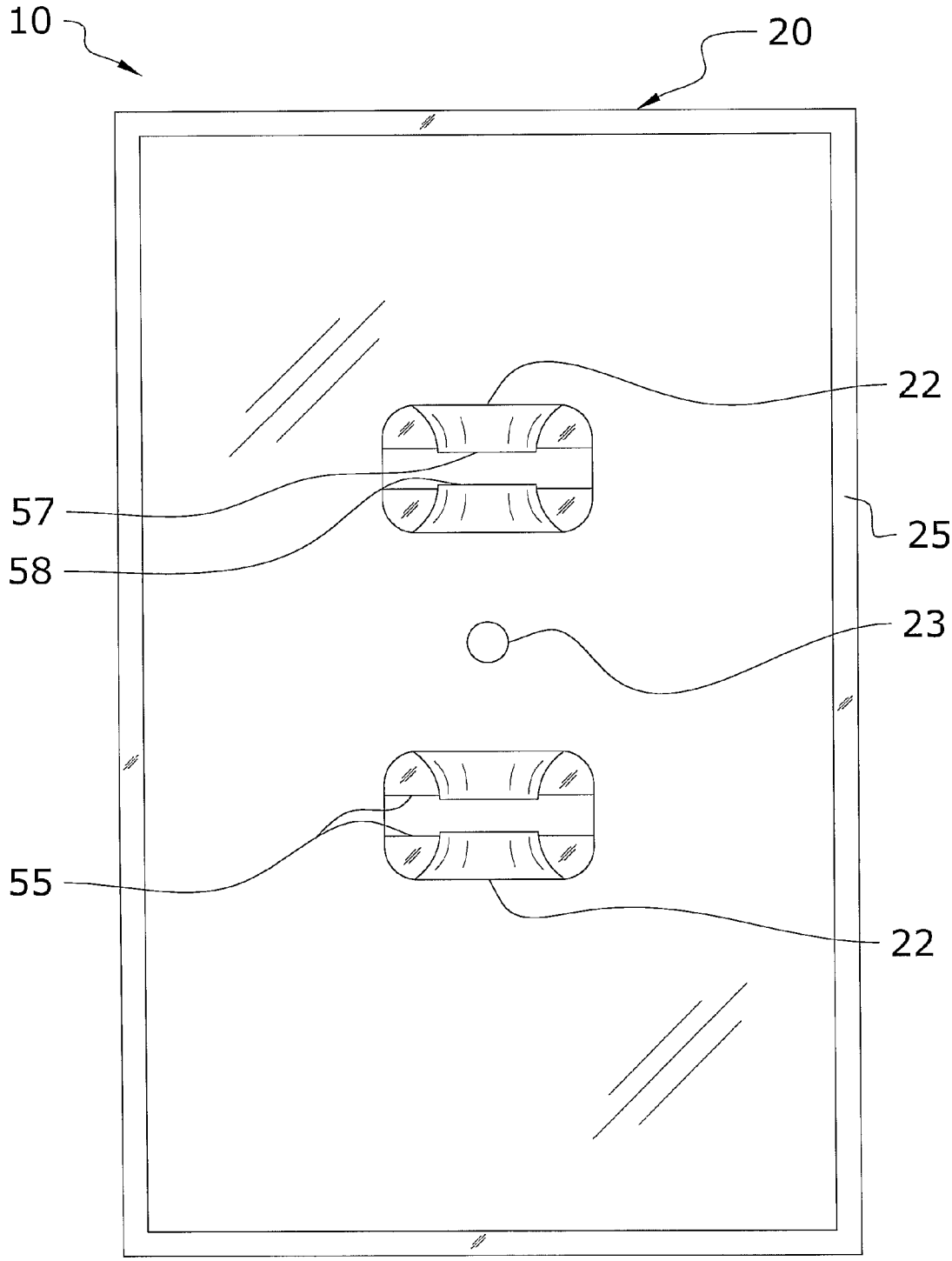
FIG. 6 is a rear view of the present invention.

In the preferred embodiment, the outer support structure 20 is comprised of a rectangular shaped configuration so as to surround the wall plate 13 of an outlet 12; however it is appreciated that the outer support structure 20 may be comprised of various sizes and configurations rather than the preferred embodiment. In the preferred embodiment, the outer support structure 20 also includes a lip 25 extending from a rear perimeter of the rear wall 21 of the outer support structure 20. The lip 25 preferably extends over an outer perimeter of the wall plate 13 and engages the wall supporting the wall plate 13 so as to stabilize the outer support structure 20 about the wall plate 13 as shown in FIGS. 3 through 5.

The outer support structure 20 is comprised of a substantially hollowed frame configuration to efficiently receive and secure the inner support structure 40 within the outer support structure 20. The outer support structure 20 includes a front opening 26 extending within a front side of the outer support structure 20, at least one rear opening 22 extending within the rear wall 21 of the rear side of the outer support structure 20 and a cavity 30 extending between the front opening 26 and the rear opening 22, wherein the cavity 30 interconnects with the front opening 26 with the rear opening 22.

The perimeter of the front opening 26 is substantially similar or slightly greater than the outer perimeter of the inner support structure 40 so that the inner support structure 40 may be extended through the front opening 26. Extending from the front opening 26 is the cavity 30, wherein the inner support structure 40 is positioned and secured within the cavity 30. The perimeter of the cavity 30 and the inner support structure 40 are preferably similar so the inner support structure 40 may be snugly positioned within the cavity 30. The cavity 30 also preferably extends substantially through the outer support structure 20 adjacent the rear wall 21 and rear opening(s) 22.

The cavity 30 preferably includes a first recessed portion 32 and a second recessed portion 33 extending within the upper and lower ends of the outer support structure 20 from the cavity 30 and adjacent the front opening 26. The first recessed portion 32 and the second recessed portion 33 are preferably comprised of a width capable of receiving a finger of an individual so as to release the inner support structure 40 from the outer support structure 20. In the preferred embodiment the first recessed portion 32 and the second recessed portion 33 are comprised of an arced shaped configuration to conform to the finger of the individual; however it is appreciated that the first recessed portion 32 and the second recessed portion 33 may be comprised of various shaped configurations.

The outer support structure 20 also preferably includes a plurality of first grooves 35 and a plurality of second grooves 36 extending within the upper and lower ends of the outer support structure 20 from the cavity 30. The first grooves 35 and the second grooves 36 comprise a portion of the securing structure of the present invention; wherein the first grooves 35 and the second grooves 36 assist in securing the inner support structure 40 within the cavity 30 of the outer support structure 20.

The first grooves 35 and the second grooves 36 are further positioned between the recessed portions 32, 33 and the end of the cavity 30 adjacent the rear wall 21 as illustrated in FIGS. 3 through 5. The first grooves 35 and the second grooves 36 are also preferably comprised of a saw tooth shaped configuration as illustrated in FIGS. 3 through 5.

The rear opening(s) 22 of the outer support structure 20 extends through the rear wall 21 from the cavity 30 and aligns with a respective outlet 12. It is appreciated that the present invention includes as many rear openings 22 as is needed to align with a corresponding number of outlets 12. The rear opening 22 is also preferably comprised of a substantially similar perimeter as the outlet 12 and the plug 17 of the electrical cord 16, wherein the plug 17 extends through the rear opening 22 and electrically connects within the outlet 12.

The outer support structure 20 further includes an aperture 23 extending through the rear wall 21. The aperture 23 preferably aligns with a threaded hole 14 of the wall plate 13 (i.e. existing hole 14 in wall plate 13 utilized to attach wall plate 13 to a housing of an outlet 12). The aperture 23 thus is aligned with the hole 14 of the wall plate 13 and the aperture 23 and hole 14 of the wall plate 13 subsequently threadably receive a fastener 19 as illustrated in FIGS. 2 through 5. The fastener 19 thus removably secures the outer support structure 20 to the wall plate 13 of the outlet 12.

D. Inner Support Structure

The inner support structure 40 is removably secured within the cavity 30 of the outer support structure 20 and also secures the plug 17 and electrical cord 16 within as illustrated in FIGS. 1 through 5. It is appreciated that the inner support structure 40 may directly attach to the wall plate 13 or outlet 12 thus eliminating the need for the outer support structure 20. The inner support structure 40 may be comprised of various shapes and configurations to attach to various configuration outlets 12, wall plates 13 and various size outer support structures 20.

The inner support structure 40 is also preferably comprised of a substantially non-conductive material, such as but not limited to plastic, to reduce the likelihood of electrical shock when handling the inner support structure 40. In the preferred embodiment, the inner support structure 40 is comprised of a rectangular shaped configuration so as to efficiently fit within the cavity 30 of the outer supports structure 20; however it is appreciated that the inner support structure 40 may be comprised of various sizes and configurations rather than the preferred embodiment all which efficiently fit within the cavity 30.

The inner support structure 40 preferably includes a first tab 42 and a second tab 45 extending from the upper and lower ends of the inner support structure 40. The first tab 42 and the second tab 45 are preferably pivotally attached to the inner support structure 40. The first tab 42 and the second tab 45 also preferably include a plurality of first securing members 43 and a plurality of second securing members 46 respectively. The first securing members 43 extend from the first tab 42 and the second securing members 46 extend outwardly from the second tab 45. The securing members 43, 46 are also preferably positioned near the pivot point of the tabs 42, 45 and rear of the recessed portions 32, 33 as illustrated in FIGS. 2 through 5.

The first securing members 43 and the second securing members 46 are preferably comprised of a saw tooth configuration and are selectively positionable within the first grooves 35 and the second grooves 36 of the outer support structure 20. The securing members 43, 46 are further angled so the inner support structure 40 may be slid within the cavity 30 without directly manipulating the tabs 42, 45 and yet prevent the inner support structure 40 from being pulled out of the cavity 30 without directly manipulating the tabs 42, 45.

When the securing members 43, 46 are positioned within the grooves 35, 36, the inner support structure 40 is preferably secured within the cavity 30. To remove the inner support structure 40 from the cavity 30 the tabs 42, 45 are depressed within the first gap portion 44 and the second gap portion 47, thus pivoting the tabs 42, 45 inward and removing the securing members 43, 46 from the respective grooves 35, 36. The tabs 42, 45 may also extend outwardly from the front opening 26 to allow the individual to more easily engage and manipulate the tabs 42, 45. The tabs 42, 45 and securing members 43, 46 also comprise a portion of the securing structure of the present invention; wherein the tabs 42, 45 and securing members 43, 46 assist in securing the inner support structure 40 within the cavity 30 of the outer support structure 20.

The inner support structure 40 also includes at least one channel 50 extending through the inner support structure 40. The channel 50 aligns with the rear opening 22 and the front opening 26. The inner support structure 40 preferably includes an equal number of channels 50 as rear openings 22 and outlets 12 as illustrated in FIGS. 1 through 6.

Each of the channels 50 includes a front portion 52 and a rear portion 51 extending from the front portion 52 and concentric with the respective outlet 12 and rear opening 22. The front portion 52 and the rear portion 51 are partially separated via a stopper member 55 extending within the channel 50 as illustrated in FIGS. 3 through 6. The stopper member 55 prevents the plug 17 from being pulled within the front portion 52 of the channel 50, wherein the plug 17 is initially positioned within the rear portion 51. The stopper member 55 is preferably comprised of a rigid structure so as to prevent the plug 17 from being pulled past the stopper member 55.

The length of the rear portion 51 is thus preferably substantially similar to the length of the plug 17 utilized with the respective outlet 12. The length of the front portion 52 and thus rest of the channel 50 may be comprised of various lengths, wherein the cord 16 extending from the plug 17 is preferably loosely positioned within the front portion 52.

In the preferred embodiment the channel 50 is comprised of a uniform diameter large enough to receive the widest part of the electrical cord 16 (i.e. generally the plug 17). However it is appreciated that the channel 50 may be comprised of varying diameters as long as the diameter rear portion 51 is large enough to be able to receive the plug 17 of the electrical cord 16 and the diameter of the front portion 52 is large enough to receive the electrical cord 16.

A first resilient member 57 and a second resilient member 58 also preferably extend within the rear portion 51 of each of the channels 50 as illustrated in FIGS. 3 through 6. The resilient members 57, 58 engage the plug 17 and assist in maintaining the plug 17 in a straight configuration and perpendicular to the outlet 12. The resilient members 57, 58 may be comprised of various configurations, such as but not limited to springs.

The inner support structure 40 further preferably includes a slot(s) 53 extending within the side of the inner support structure 40 and interconnecting with the channel(s) 50. The inner support structure 40 preferably includes an equal number of slots 53 as channels 50, wherein each electrical cord 16 that is to be positioned within a desired channel 50 is slid into the channel 50 via a respective slot 53.

The slots 53 preferably extend along an entire length of the channel 50 and interconnect the channel 50 with the outside of the inner support structure 40. It is appreciated that the slot 53 only needs to be wide enough to accommodate the electrical cord 16, wherein the plug 17 may be slid into the channel 50 via the pulling the electrical cord 16 through the channel 50 toward the front of the inner support structure 40 once the cord 16 is positioned within the channel 50.

E. Operation of Preferred Embodiment

In use, the fastener 19 is first removed from the wall plate 13 surrounding the outlets 12 and the aperture 23 of the outer support structure 20 is aligned with the hole 14 of the wall plate 13 (that previously held the fastener 19) ensuring that the rear wall 21 is positioned against the wall plate 13, the lip 25 surrounds the outer perimeter of the wall plate 13 and the rear openings 22 align with the respective outlets 12.

The fastener 19 is now extended through the aperture 23 and within the hole 14 of the wall plate 13 and subsequently tightened (e.g. via threadably tightening, etc.). The electrical cord 16 (that is desired to be electrically connected to the outlet 12) is now extended through the slot 53 and within the respective channel 50 ensuring that the plug 17 is positioned on an adjacent end of the inner support structure 40 as the rear portion 51 of the channel 50.

The plug 17 may now be extended through the rear openings 22 and electrically connected to the respective outlet 12 in a normal manner consistent with connecting plugs 17 of electrical cords 16 to outlets 12. Additional cords 16 may be positioned within additional channels 50 and the respective plugs 17 connected to the outlet 12 via following the previously described procedure (i.e. extending the cords 16 through additional slots 53 within additional channels 50).

The inner support structure 40 may now be extended along the electrical cord 16 toward the outer support structure 20.

The inner support structure 40 is subsequently extended within the cavity 30 until the securing members 43, 46 of the inner support structure 40 are positioned within the grooves 35, 36 of the outer support structure 20.

The plug 17 should now be fully positioned within the rear portion 51 of the channel 50 and the inner support structure 40 should be secured within the outer support structure 20. If an individual accidentally pulls on the electrical cord 16, the plug 17 is prevented from disconnecting from the outlet 12 via the stopper member 55 holding the plug 17 in place within the channel 50 and the inner support structure 40 being secured to the outer support structure 20 which is secured to the wall plate 13 of the outlet 12.

To remove a particular electrical cord 16 from the outlet 12 or add an additional electrical cord 16 to the present invention, the inner support structure 40 is first removed from the outer support structure 20. The individual does this be simultaneously manipulating each tab 42, 45 inwards until the securing members 43, 46 are removed from the grooves 35, 36 as illustrated in FIG. 4. The inner support structure 40 may now be pulled away from the outer support structure 20 and the outlet 12 as illustrated in FIG. 5.

The desired electrical cord 16 may now be disconnected from the outlet 12 and removed from the inner support structure 40 or an additional electrical cord 16 may be positioned within an empty slot 53 and channel 50. The inner support structure 40 may now be repositioned within the cavity 30 according to the previously described procedure.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An outlet attachment system, comprising:

a support structure including at least one elongated channel and at least one stopper member, wherein said at least one elongated channel extends through said support structure;

wherein said at least one elongated channel includes a front portion and a rear portion, wherein said front portion extends from said rear portion;

wherein said at least one stopper member extends partially within said at least one elongated channel between said front portion and said rear portion;

wherein said support structure is secured adjacent an outlet and wherein said rear portion of said at least one elongated channel aligns with said outlet.

2. The outlet attachment system of claim 1, wherein said support structure includes at least one elongated slot, wherein said at least one elongated slot extends within a side of said support structure and interconnects with said at least one elongated channel.

3. The outlet attachment system of claim 2, wherein said at least one elongated slot is parallel to said at least one channel.

4. The outlet attachment system of claim 1, wherein a plug of an electrical cord is firmly secured between said outlet and said rear portion of said at least one elongated channel via said at least one stopper member.

5. The outlet attachment system of claim 1, including at least one resilient member extending within said rear portion of said at least one elongated channel.

6. The outlet attachment system of claim 5, wherein said at least one resilient member is comprised of a spring.

7. An outlet attachment system, comprising:

an outer support structure including a front opening, at least one rear opening and a cavity extending between said front opening and said at least one rear opening;

an inner support structure including at least one channel extending through said inner support structure, wherein said at least one channel aligns with said front opening and said at least one rear opening;

at least one stopper member extending within said at least one channel; and a securing structure extending between said outer support structure and said inner support structure, wherein said securing structure removably secures said inner support structure within said cavity of said outer support structure.

8. The outlet attachment system of claim 7, wherein said securing structure includes a plurality of securing members extending from said inner support structure and a plurality of grooves extending within said outer support structure, wherein said plurality of securing members are selectively positioned within said plurality of grooves.

9. The outlet attachment system of claim 8, wherein said plurality of securing members and said plurality of grooves are comprised of a saw tooth configuration.

10. The outlet attachment system of claim 8, wherein said securing members extend outwardly from at least one tab extending from said inner support structure, wherein said at least one tab is movably connected to said inner support structure.

11. The outlet attachment system of claim 10, wherein said at least one tab is pivotally connected to said inner support structure.

12. The outlet attachment system of claim 7, wherein said securing structure is comprised of a ratcheting configuration.

13. The outlet attachment system of claim 7, wherein said outer support structure includes at least one recessed portion extending within said outer support structure adjacent said front opening and from said cavity, wherein said at least one recessed portion is comprised of an arced configuration.

14. The outlet attachment system of claim 7, wherein said outer support structure includes a lip extending outwardly from a rear perimeter of said outer support structure.

15. The outlet attachment system of claim 7, wherein said inner support structure includes at least one slot, wherein said at least one slot extends within a side of said inner support structure and interconnects with said at least one channel.

16. The outlet attachment system of claim 15, wherein said at least one slot is parallel to said at least one channel.

17. The outlet attachment system of claim 7, wherein a plug of an electrical cord is firmly secured within said at least one channel and between said at least one stopper member and an outlet.

18. The outlet attachment system of claim 7, including at least one resilient member extending within said at least one channel.

19. The outlet attachment system of claim 7, wherein said at least one channel is concentric with said at least one rear opening.

20. An outlet attachment system, comprising:

an outer support structure including a front opening, at least one rear opening and a cavity extending between said front opening and said at least one rear opening;

an inner support structure including at least one channel extending through said inner support structure, wherein said at least one channel aligns with said front opening and said at least one rear opening;

wherein said at least one channel is comprised of an elongated configuration;

at least one stopper member extending within said at least one channel; and a securing structure extending between said outer support structure and said inner support structure, wherein said securing structure removably secures said inner support structure within said cavity of said outer support structure;

wherein said securing structure is comprised of a ratcheting configuration;

wherein said securing structure includes a plurality of securing members extending from said inner support structure and a plurality of grooves extending within said outer support structure, wherein said plurality of securing members are selectively positioned within said plurality of grooves;

wherein said plurality of securing members and said plurality of grooves are comprised of a saw tooth configuration;

wherein said securing members extend outwardly from at least one tab extending from said inner support structure, wherein said at least one tab is pivotally connected to said inner support structure;

wherein said outer support structure includes at least one recessed portion extending within said outer support structure adjacent said front opening and from said cavity and wherein said at least one recessed portion is comprised of an arced configuration;

wherein said outer support structure includes a lip extending outwardly from a rear perimeter of said outer support structure;

wherein said inner support structure includes at least one slot, wherein said at least one slot extends within a side of said inner support structure and interconnects with said at least one channel;

wherein said at least one slot is parallel to said at least one channel and wherein said at least one slot is comprised of an elongated configuration;

wherein said at least one channel is concentric with said at least one rear opening.

* * * * *